US007954259B2

(12) United States Patent
Antonelli et al.

(10) Patent No.: US 7,954,259 B2
(45) Date of Patent: Jun. 7, 2011

(54) SOLE ELEMENT FOR A SHOE

(75) Inventors: Bruno Jean Antonelli, Herzogenaurach (DE); Wolfgang Scholz, Lonnerstadt (DE); Jürgen Weidl, Aurachtal (DE); Josh Robert Gordon, Nürnberg (DE); Jan Hill, Groβenseebach (DE); Gerd Rainer Manz, Weisendorf (DE)

(73) Assignee: adidas International Marketing B.V., Amsterdam (NL)

( * ) Notice: Subject to any disclaimer, the term of this patent is extended or adjusted under 35 U.S.C. 154(b) by 792 days.

(21) Appl. No.: 11/732,831

(22) Filed: Apr. 4, 2007

(65) Prior Publication Data

US 2007/0256329 A1 Nov. 8, 2007

(51) Int. Cl.
*A43B 23/08* (2006.01)
*A43B 13/14* (2006.01)
*A43B 13/18* (2006.01)

(52) U.S. Cl. ..... 36/69; 36/25 R; 36/45; 36/30 R; 36/4

(58) Field of Classification Search ..... 36/69, 25 R, 36/45, 30 R, 7.8, 68, 28, 103, 4, 101
See application file for complete search history.

(56) References Cited

U.S. PATENT DOCUMENTS

| | | | |
|---|---|---|---|
| 1,841,942 | A | 1/1932 | Fenton |
| 2,224,590 | A | 12/1940 | Boivin |
| 2,547,480 | A | 4/1951 | McDaniel |
| 2,863,231 | A | 12/1958 | Jones |
| 3,550,597 | A | 12/1970 | Coplans |
| 3,834,046 | A | 9/1974 | Fowler |
| 4,000,566 | A | 1/1977 | Famolare, Jr. et al. |
| D247,267 | S | 2/1978 | Dolinsky |
| 4,083,125 | A | 4/1978 | Benseler et al. |
| 4,130,947 | A | 12/1978 | Denu et al. |
| 4,139,187 | A | 2/1979 | Hanusa |
| 4,224,774 | A | 9/1980 | Petersen et al. |
| 4,236,326 | A | 12/1980 | Inohara et al. |
| 4,296,557 | A | 10/1981 | Pajevic |
| 4,314,413 | A | 2/1982 | Dassler et al. |
| 4,354,318 | A | 10/1982 | Frederick et al. |
| 4,364,189 | A | 12/1982 | Bates |
| 4,391,048 | A | 7/1983 | Lutz et al. |
| 4,438,573 | A | 3/1984 | McBarron |
| 4,451,994 | A | 6/1984 | Fowler |
| 4,492,046 | A | 1/1985 | Kosova |

(Continued)

FOREIGN PATENT DOCUMENTS

| | | |
|---|---|---|
| CA | 1249930 | 2/1989 |

(Continued)

OTHER PUBLICATIONS

European Search Report for related Application No. EP 10 17 9301, mailed from the European Patent Office on Feb. 16, 2011 (5 pages).

(Continued)

*Primary Examiner* — Ted Kavanaugh
(74) *Attorney, Agent, or Firm* — Kilpatrick Townsend & Stockton LLP

(57) ABSTRACT

The invention relates to a shoe having a sole element. The sole element includes a sole area extending below a wearer's foot and a heel cup three-dimensionally encompassing a heel of the wearer's foot. The heel cup alone forms at least a portion of a sidewall of the shoe.

21 Claims, 7 Drawing Sheets

U.S. PATENT DOCUMENTS

| | | | | |
|---|---|---|---|---|
| 4,498,251 | A | | 2/1985 | Shin et al. |
| 4,506,461 | A | | 3/1985 | Inohara et al. |
| 4,507,879 | A | | 4/1985 | Dassler et al. |
| 4,523,393 | A | | 6/1985 | Inohara et al. |
| 4,524,529 | A | | 6/1985 | Schaefer et al. |
| 4,535,553 | A | | 8/1985 | Derderian et al. |
| 4,536,974 | A | | 8/1985 | Cohen |
| 4,551,930 | A | | 11/1985 | Graham et al. |
| 4,566,206 | A | | 1/1986 | Weber |
| 4,592,153 | A | | 6/1986 | Jacinto |
| 4,610,099 | A | | 9/1986 | Signori et al. |
| 4,611,412 | A | | 9/1986 | Cohen |
| 4,616,431 | A | | 10/1986 | Dassler et al. |
| 4,617,745 | A | | 10/1986 | Batra |
| 4,624,061 | A | | 11/1986 | Wezel et al. |
| 4,654,983 | A | | 4/1987 | Graham et al. |
| 4,676,010 | A | | 6/1987 | Cheskin |
| 4,676,011 | A | | 6/1987 | O'Rourke et al. |
| 4,707,874 | A | * | 11/1987 | Champagne ..... 12/142 E |
| 4,753,021 | A | | 6/1988 | Cohen |
| 4,754,559 | A | | 7/1988 | Cohen |
| 4,759,136 | A | | 7/1988 | Stewart et al. |
| 4,771,554 | A | | 9/1988 | Hannemann |
| 4,774,774 | A | | 10/1988 | Allen, Jr. |
| 4,798,009 | A | | 1/1989 | Colonel et al. |
| 4,798,010 | A | | 1/1989 | Sugiyama et al. |
| 4,843,741 | A | | 7/1989 | Yung-Mao et al. |
| 4,864,738 | A | | 9/1989 | Horovitz |
| 4,874,640 | A | | 10/1989 | Donzis |
| 4,876,053 | A | | 10/1989 | Norton et al. |
| 4,881,329 | A | | 11/1989 | Crowley |
| 4,905,383 | A | | 3/1990 | Beckett et al. |
| 4,910,884 | A | | 3/1990 | Lindh et al. |
| 4,918,841 | A | | 4/1990 | Turner et al. |
| 4,934,070 | A | | 6/1990 | Mauger et al. |
| 4,947,560 | A | | 8/1990 | Fuerst et al. |
| 4,949,476 | A | | 8/1990 | Anderie |
| 4,972,611 | A | | 11/1990 | Swartz et al. |
| 4,999,931 | A | | 3/1991 | Vermeulen et al. |
| 5,014,706 | A | | 5/1991 | Philipp et al. |
| 5,048,203 | A | | 9/1991 | Kling |
| 5,052,130 | A | | 10/1991 | Barry et al. |
| 5,060,401 | A | | 10/1991 | Whatley |
| 5,065,531 | A | * | 11/1991 | Prestridge ..... 36/100 |
| 5,070,629 | A | | 12/1991 | Graham et al. |
| D324,940 | S | | 3/1992 | Claveria |
| D326,956 | S | | 6/1992 | Damianoe et al. |
| 5,131,173 | A | | 7/1992 | Anderie et al. |
| D330,797 | S | | 11/1992 | Lucas |
| 5,179,791 | A | | 1/1993 | Lain |
| 5,189,816 | A | | 3/1993 | Shibata et al. |
| 5,191,727 | A | | 3/1993 | Barry et al. |
| 5,195,254 | A | | 3/1993 | Tyng et al. |
| 5,195,256 | A | | 3/1993 | Kim et al. |
| D336,561 | S | | 6/1993 | Hatfield |
| D343,272 | S | | 1/1994 | James |
| 5,279,051 | A | | 1/1994 | Whatley |
| D344,174 | S | | 2/1994 | Kilgore |
| 5,297,349 | A | | 3/1994 | Kilgore |
| D347,105 | S | | 5/1994 | Johnson |
| 5,337,492 | A | | 8/1994 | Anderie et al. |
| 5,339,544 | A | | 8/1994 | Caberlotto |
| D350,227 | S | | 9/1994 | Kilgore |
| D350,433 | S | | 9/1994 | Kilgore |
| 5,343,639 | A | | 9/1994 | Kilgore et al. |
| D351,057 | S | | 10/1994 | Kilgore |
| 5,353,523 | A | | 10/1994 | Kilgore et al. |
| 5,353,526 | A | | 10/1994 | Foley et al. |
| 5,353,528 | A | | 10/1994 | Demarchi et al. |
| D352,160 | S | | 11/1994 | Kilgore |
| 5,367,792 | A | | 11/1994 | Richard et al. |
| 5,369,896 | A | * | 12/1994 | Frachey et al. ..... 36/29 |
| D354,617 | S | | 1/1995 | Kilgore |
| 5,381,608 | A | | 1/1995 | Claveria |
| D355,755 | S | | 2/1995 | Kilgore |
| 5,461,800 | A | | 10/1995 | Luthi et al. |
| 5,469,638 | A | | 11/1995 | Crawford, III |
| 5,469,639 | A | | 11/1995 | Sessa |
| 5,488,786 | A | | 2/1996 | Ratay |
| 5,493,791 | A | | 2/1996 | Kramer |
| 5,493,792 | A | | 2/1996 | Bates et al. |
| 5,502,901 | A | | 4/1996 | Brown |
| 5,511,324 | A | | 4/1996 | Smith |
| 5,513,448 | A | | 5/1996 | Lyons |
| 5,544,431 | A | | 8/1996 | Dixon |
| 5,560,126 | A | | 10/1996 | Meschan et al. |
| 5,572,805 | A | | 11/1996 | Giese et al. |
| 5,577,334 | A | | 11/1996 | Park et al. |
| D376,471 | S | | 12/1996 | Kalin et al. |
| 5,615,497 | A | | 4/1997 | Meschan |
| 5,625,964 | A | | 5/1997 | Lyden et al. |
| 5,644,857 | A | | 7/1997 | Ouellette et al. |
| 5,647,145 | A | | 7/1997 | Russell et al. |
| 5,671,552 | A | | 9/1997 | Pettibone et al. |
| 5,678,327 | A | | 10/1997 | Halberstadt |
| 5,701,686 | A | | 12/1997 | Herr et al. |
| 5,718,063 | A | | 2/1998 | Yamashita et al. |
| 5,720,118 | A | | 2/1998 | Mayer et al. |
| 5,743,028 | A | | 4/1998 | Lombardino |
| 5,752,329 | A | | 5/1998 | Horibata et al. |
| 5,761,831 | A | | 6/1998 | Cho et al. |
| 5,782,014 | A | | 7/1998 | Peterson |
| 5,806,208 | A | | 9/1998 | French |
| 5,806,209 | A | | 9/1998 | Crowley et al. |
| 5,806,210 | A | | 9/1998 | Meschan |
| 5,822,886 | A | | 10/1998 | Luthi et al. |
| 5,826,352 | A | | 10/1998 | Meschan et al. |
| 5,832,634 | A | | 11/1998 | Wong et al. |
| 5,852,886 | A | | 12/1998 | Slepian et al. |
| 5,875,567 | A | | 3/1999 | Bayley |
| 5,875,568 | A | | 3/1999 | Lennihan, Jr. |
| 5,893,219 | A | | 4/1999 | Smith et al. |
| 5,915,820 | A | | 6/1999 | Kraeuter et al. |
| 5,918,384 | A | | 7/1999 | Meschan |
| 5,926,974 | A | | 7/1999 | Friton |
| 5,937,544 | A | | 8/1999 | Russell |
| 5,937,545 | A | | 8/1999 | Dyer et al. |
| 5,970,628 | A | | 10/1999 | Meschan |
| 5,983,529 | A | | 11/1999 | Serna |
| 5,987,781 | A | | 11/1999 | Pavesi et al. |
| 5,996,253 | A | | 12/1999 | Spector |
| 5,996,260 | A | | 12/1999 | MacNeill |
| 6,006,449 | A | | 12/1999 | Orlowski et al. |
| 6,009,641 | A | | 1/2000 | Ryan |
| 6,023,859 | A | | 2/2000 | Burke et al. |
| 6,029,374 | A | | 2/2000 | Herr et al. |
| 6,050,002 | A | | 4/2000 | Meschan |
| 6,055,746 | A | | 5/2000 | Lyden et al. |
| 6,115,944 | A | | 9/2000 | Lain |
| 6,119,373 | A | | 9/2000 | Gebhard et al. |
| 6,127,010 | A | | 10/2000 | Rudy |
| D434,549 | S | | 12/2000 | Solaroli |
| 6,195,916 | B1 | | 3/2001 | Meschan |
| 6,199,302 | B1 | | 3/2001 | Kayano et al. |
| 6,199,303 | B1 | | 3/2001 | Luthi et al. |
| 6,237,251 | B1 | | 5/2001 | Litchfield et al. |
| 6,253,466 | B1 | | 7/2001 | Harmon-Weiss et al. |
| 6,282,814 | B1 | | 9/2001 | Krafsur et al. |
| 6,301,806 | B1 | | 10/2001 | Heller et al. |
| 6,324,772 | B1 | | 12/2001 | Meschan |
| D453,989 | S | | 3/2002 | Cagner |
| 6,354,020 | B1 | | 3/2002 | Kimball et al. |
| 6,449,235 | B1 | | 9/2002 | Kim et al. |
| 6,487,796 | B1 | | 12/2002 | Avar et al. |
| 6,568,102 | B1 | | 5/2003 | Healy et al. |
| 6,604,300 | B2 | | 8/2003 | Meschan |
| 6,662,471 | B2 | | 12/2003 | Meschan |
| 6,708,427 | B2 | | 3/2004 | Sussmann et al. |
| 6,722,058 | B2 | | 4/2004 | Lucas et al. |
| 6,751,891 | B2 | | 6/2004 | Lombardino |
| 6,920,705 | B2 | | 7/2005 | Lucas et al. |
| 6,954,998 | B1 | | 10/2005 | Lussier |
| 6,957,503 | B2 | | 10/2005 | De Paoli et al. |
| 7,013,582 | B2 | | 3/2006 | Lucas et al. |
| 7,047,675 | B2 | | 5/2006 | Briant et al. |
| 7,200,955 | B2 | * | 4/2007 | Foxen ..... 36/25 R |
| 7,401,422 | B1 | | 7/2008 | Scholz et al. |

| | | | | |
|---|---|---|---|---|
| 2001/0049888 | A1 | 12/2001 | Krafsur et al. | |
| 2002/0078601 | A1 | 6/2002 | Alfond et al. | |
| 2002/0112379 | A1 | 8/2002 | Sussmann et al. | |
| 2002/0129516 | A1 | 9/2002 | Lucas et al. | |
| 2002/0189132 | A1 | 12/2002 | Yamamoto | |
| 2003/0000109 | A1 | 1/2003 | Kita | |
| 2005/0198868 | A1 | 9/2005 | Scholz | |
| 2006/0265905 | A1 | 11/2006 | Chandler et al. | |
| 2006/0288612 | A1 | 12/2006 | Lucas et al. | |
| 2007/0107257 | A1* | 5/2007 | Laska | 36/4 |

FOREIGN PATENT DOCUMENTS

| | | |
|---|---|---|
| DE | 39 24 360 | 1/1991 |
| DE | G9210113.5 | 9/1992 |
| DE | 10234913 | 2/2004 |
| EP | 0192820 | 9/1986 |
| EP | 0299669 | 1/1989 |
| EP | 0359421 | 3/1990 |
| EP | 0389752 | 10/1990 |
| EP | 0558541 | 9/1993 |
| EP | 0694264 | 1/1996 |
| EP | 0714246 | 6/1996 |
| EP | 0714611 | 6/1996 |
| EP | 0752216 | 1/1997 |
| EP | 0815757 | 1/1998 |
| EP | 0877177 | 11/1998 |
| EP | 0916277 | 5/1999 |
| EP | 1118280 | 7/2001 |
| EP | 0 741 529 | 10/2001 |
| EP | 1 048 233 | 4/2006 |
| GB | 809051 | 2/1959 |
| JP | S632475 | 5/1993 |
| WO | WO-9520333 | 8/1995 |
| WO | WO-9713422 | 4/1997 |
| WO | WO-9904662 | 2/1999 |
| WO | WO-9929203 | 6/1999 |
| WO | WO-0117384 | 3/2001 |
| WO | WO-2005/004656 | 1/2005 |
| WO | WO 2005/075034 | 8/2005 |

OTHER PUBLICATIONS

European Search Report for related Application No. EP 10 17 9298, mailed from the European Patent Office on Feb. 14, 2011 (6 pages).

* cited by examiner

SOLE ELEMENT FOR A SHOE

CROSS-REFERENCE TO RELATED APPLICATION

This application claims priority to and the benefit of, German Patent Application Serial No. 10 2006 015 649, filed on Apr. 4, 2006, the entire disclosure of which is hereby incorporated by reference herein.

TECHNICAL FIELD

The present invention relates to a shoe sole, and more particularly a sole element for a shoe sole.

BACKGROUND OF THE INVENTION

Shoes need to meet a plurality of technical requirements, such as effectively cushioning ground reaction forces acting on the body, supporting a correct step cycle, and correcting mis-orientations, if necessary. At the same time the shoe, in particular a sports shoe, should be as lightweight as possible, since the energy needed for a course of motion of the shoe is a function of the weight of the shoe. Thus, it is an object of the development of modern sports shoes to meet the described biomechanical requirements and to produce a long-lasting shoe with the lowest possible weight.

In the past, improvements focused on the shoe sole. For example, the assignee of the present application disclosed in issued U.S. Pat. Nos. 5,337,492, 6,920,705, and 7,013,582, and European Application No. EP 0 741 529 A1, the entire disclosures of which are hereby incorporated by reference herein, different sole designs where the commonly used homogenous ethylene-vinyl acetate (EVA) midsole is at least partly replaced by individual elements. In addition, the aforementioned references also disclose the use of cushioning elements that no longer consist of foamed materials, but use elastic framework structures that significantly reduce the weight of the shoe sole and at the same time increase the life of the shoe.

With respect to the design of a shoe in the area above the shoe sole, however, the shoes disclosed in the aforementioned documents use an approach where the shoe upper, starting from the edge of the sole, extends upwardly around the foot. A separate heel cup may be integrated for reinforcing the heel region. For example, assignee's European Patent No. EP 1 048 233 B1, the entire disclosure of which is hereby incorporated by reference herein, discloses a sprint plate having a heel cup integrated into the shoe upper, which serves to improve the performance of the runner. This design of the shoe upper and its interconnection to the sole leads, however, to a shoe having significant weight. Furthermore, a plurality of individual parts must be manually sewn or glued together during manufacture of the shoe, which adds complexity and increases costs.

There is, therefore, a need for a long-lasting shoe, in particular a sports shoe, where the weight above the sole is optimized and, in addition, is particularly easy to produce.

SUMMARY OF THE INVENTION

The present invention solves this problem by a shoe, in particular a sports shoe, having a one-piece sole element. The sole element includes a sole area extending below the foot and a heel cup that three-dimensionally encompasses the heel of the foot, wherein the heel cup alone forms at least a partial area of a side wall of the shoe.

A one-piece sole element in accordance with the invention, therefore, provides not only a component of the sole, but also at least partially replaces the typical sidewalls in the heel region of the shoe. Traditionally, the sidewalls are provided by the upper material reinforced with a separate heel cup. A shoe manufactured with a sole element in accordance with the invention results in a stable transition between the sole region and the upper of the shoe and can be cost-efficiently produced. Additionally, the overall shoe can be manufactured with a lower weight, since the sole element can be made from lightweight plastic materials and replaces the comparatively heavy materials of the shoe upper, for example leather or fabric with the integrated reinforcing elements for the heel, as well as a possible separate insole and/or other sole components, such as a lasting board. Furthermore, the manufacturing effort for a shoe in accordance with the invention is substantially reduced. Sewing the shoe upper directly to the sole is at least partly no longer necessary, and the overall number of components necessary for the manufacture of the shoe is substantially decreased.

In one aspect, the invention relates to a shoe including an upper and a sole. The sole includes a one-piece sole element. The one-piece sole element includes a sole area configured to extend below a wearer's foot and a heel cup extending upwardly from at least a portion of the sole area and configured to three-dimensionally encompass a heel of the wearer's foot. The heel cup solely forms at least a portion of a sidewall of the shoe.

In another aspect, the invention relates to a sole assembly for a shoe. The sole assembly can include a sole element having a sole area at least partially extending below a region corresponding to a sole of a wearer's foot and configured to distribute loads arising thereon and a heel cup extending upwardly from at least a portion of the sole area and configured to three-dimensionally encompass a heel of the wearer's foot. The heel cup solely forms at least a portion of a sidewall of the shoe. The sole assembly also includes at least one cushioning element disposed at least partially below the sole area of the sole element.

In various embodiments of the foregoing aspect, the at least one cushioning element can be a structural cushioning element. The structural cushioning element can include at least two side walls and at least one tension element interconnecting center regions of the side walls. Various types of cushioning and structural elements are described in U.S. Pat. No. 6,722,058 and U.S. Patent Publication No. 2006/0265905, the entire disclosures of which are hereby incorporated by reference herein. In addition, the sole assembly can include at least one of an insole, a midsole, or an outsole.

In various embodiments of the foregoing aspects, the portion of the sidewall extends forward of the heel cup to at least a region corresponding to a midfoot region of a wearer's foot. The one-piece sole element can be made from a plurality of materials by multi-component injection molding. As a result, the material properties can be optimized in different regions of the sole element, for example with respect to the weight, the stiffness, and/or the outer appearance, without requiring additional manufacturing steps for sewing, gluing or otherwise connecting a plurality of individual components. At least a portion of the shoe upper can be attached to an upper edge of the heel cup, and the upper edge can include a reduced thickness and/or a softer material than at least one other region or all other regions of the sole element. This arrangement leads to a smooth transition in the shoe between the one-piece sole element and the shoe upper. Further, the reduced thickness of the upper edge of the heel cup facilitates the attachment to the upper, for example, by sewing.

In one embodiment, the sole element includes a harder material in the heel cup and/or a central forefoot region of the sole element than in at least one other region or all other regions of the sole element. The sole element can extend laterally upwardly in a region corresponding to an arch of a wearer's foot to form a portion of a sidewall to encompass a midfoot region (e.g., up to the instep) of the wearer's foot. Accordingly, the one-piece sole element becomes a chassis-like element of the overall shoe design and encompasses the foot from a plurality of sides. In addition, the sole area of the sole element can extend from a heel region at least to a region corresponding to a midfoot region of a wearer's foot. In one embodiment, which is suitable for soccer shoes, the sole area of the sole element can extend essentially over the complete area below the foot. As a result, the one piece sole element substantially determines the deformation properties of the shoe under load.

Furthermore, the sole element can include at least one transparent region or be made of a transparent material. The sole element can include at least one ventilation opening and/or reinforcing ribs. The foregoing features can be arranged in the region where the sole element alone forms the side wall of the shoe. These features can easily influence the aesthetic appearance of the shoe, its ventilation properties, and/or the stiffness of the shoe. Additionally or alternatively, the sole element can include at least one receptacle for receiving a profile element of the shoe arranged in the sole area of the sole element. The receptacle can form an opening in the sole area.

In various embodiments, the sole area can be configured as a load distribution plate and at least one cushioning element can be arranged below the load distribution plate. This embodiment may be particularly suitable for running shoes. This embodiment also facilitates the use of the aforementioned sole constructions disclosed by the assignee, which can also reduce the weight and increase the life of the shoe. In one embodiment, a plurality of cushioning elements can be arranged below the load distribution plate. A direct connection between the plate and the cushioning elements can lead to more effective load distribution. The cushioning elements can be interconnected on their bottom surfaces or lower edges by at least one of an intermediate layer and a common outsole. A region of the sole element corresponding to a calcaneus bone of a wearer can include an opening and/or a material softer than in surrounding regions of the sole area. This feature not only increases the wearing comfort of the shoe, but also avoids localized excessive loads on the plastic material used for the sole area, in particular in the case of a sole element having a comparatively stiff sole area. The shoe can also include a suitable cushioning insole having a reinforcement in the region corresponding to the wearer's calcaneus bone. If an additional cushioning layer made from a flexible material is arranged on top of the opening and/or this region, for example the aforementioned insole, the cushioning material may, in the case of an excessive load, as may occur below the calcaneus bone during ground contact with the heel, expand into the opening or the more flexible region. Using an appropriate reinforcement of the insole in this region, this expansion may be limited to avoid damage. In one embodiment, an additional cushioning element can be arranged below the sole area in the region corresponding to the wearer's calcaneus bone.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following, embodiments of the sole and the sole element in accordance with the invention are further described with reference to a shoe sole for a sports shoe. It is, however, to be understood that the present invention can also be used for other types of shoes that are intended to have, for example, good cushioning properties, a low weight, and a long life. In addition, the present invention can also be used in other areas of a sole, instead of or in addition to the heel region.

Figure 1:
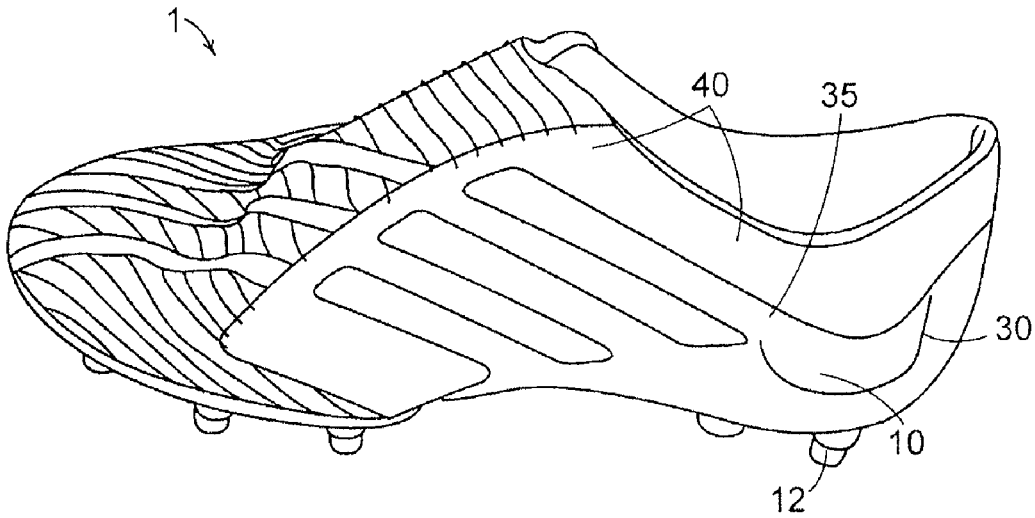
FIG. 1 is a schematic perspective side view of a shoe in accordance with one embodiment of the invention.
Figure 2:
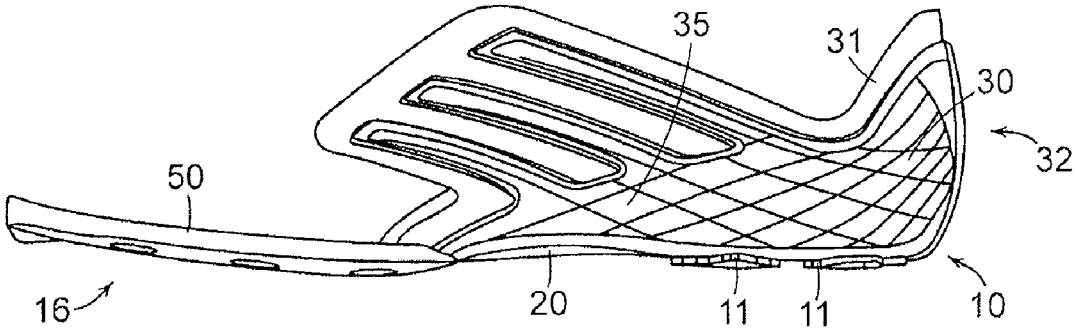
FIG. 2 is a schematic side view of a sole element for the shoe of FIG. 1, in accordance with one embodiment of the invention.

FIGS. 1 and 2 depict one embodiment of a shoe 1 (FIG. 1) and a sole element 10 (FIG. 2) for use in the shoe 1. As shown, the sole element 10 is provided as a one-piece component. Starting from a sole area 20 that extends along a region corresponding to an area below a wearer's foot, the sole element 10 includes a heel cup 30 configured to encompass a heel of the wearer's foot. In contrast to known designs, this heel cup 30, however, is not fully integrated into the upper 40 of the shoe 1. Instead, in the region 32 corresponding to the wearer's heel, the heel cup 30 exclusively forms the sidewall of the shoe upper 40 that encompasses a portion of the wearer's foot.

As a consequence, in the heel region 32, the shoe upper 40 does not extend down to the sole, but is attached to an upper edge 31 of the sole element 10. To accomplish this, different techniques can be used to affix the shoe upper 40 to the upper edge 31 of the sole element 10, such as, for example, gluing, welding, or sewing. In contrast to a common shoe, the shoe upper 40 of the present invention extends only over a reduced portion of the exterior surface of the shoe upper 40. The weight of the shoe upper 40 is, therefore, reduced (e.g., as a result of avoiding duplication of material layers), which in turn reduces the amount of energy required for any movement of the shoe by the wearer of the shoe.

The sole element 10 shown in FIGS. 1 and 2 also extends starting from its sole area 20 upwardly into a lateral side region 35. The side region 35 with its rib-like structure illustrates that the one-piece sole element 10 can be made from several materials. For example, the upper edge 31 can be made from a comparatively flexible plastic material, e.g., a soft thermoplastic urethane (TPU), while a harder TPU might be used in the embodiment of FIGS. 1 and 2 for the heel cup 30, which supports the wearer's foot from the rear and, thereby, increases the stability of the overall shoe.

The manufacture of the sole element 10 as one piece from two or more materials is possible by multi-component injection molding. The different materials can be either sequentially or simultaneously injected into a suitable mold or a second sole material can be injected around a preform. The preform provides for reinforcement and is placed in the mold prior to injection of the second material. These manufacturing techniques are known to the person of ordinary skill in the art and, therefore, do not have to be further explained.

In addition, various portions and/or additional components (e.g., cushioning elements) of the sole and/or sole element 10 can be manufactured by, for example, injection molding or extrusion. Insert molding techniques can be used to provide the desired geometry of, for example, the ventilation openings 373 (FIG. 6) and stud receptacles 11 (FIG. 2), or the various openings could be created in the desired locations by a subsequent machining operation. Other manufacturing techniques include melting or bonding additional portions. For example, reinforcing elements may be adhered to the sole element 10 with a liquid epoxy or a hot melt adhesive, such as EVA. In addition to adhesive bonding, portions can be solvent bonded, which entails using a solvent to facilitate fusing of the portions to be joined.

The various components can be manufactured from any suitable polymeric material or combination of polymeric materials, either with or without reinforcement. Suitable materials include: polyurethanes, such as the aforementioned TPU and EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

The specific size, geometry, and materials selected for the sole element 10 and various components can vary to suit a particular application, including the requirements for the shoe in general (e.g., type and size), its expected field of use, and the size and weight of the wearer.

Figure 3A:
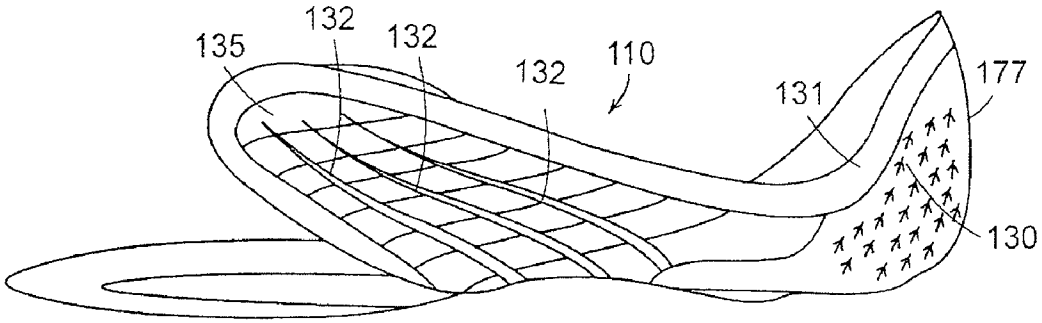
FIGS. 3A-3C are schematic side, bottom, and rear views of a sole element in accordance with an alternative embodiment of the invention.
Figure 3B:
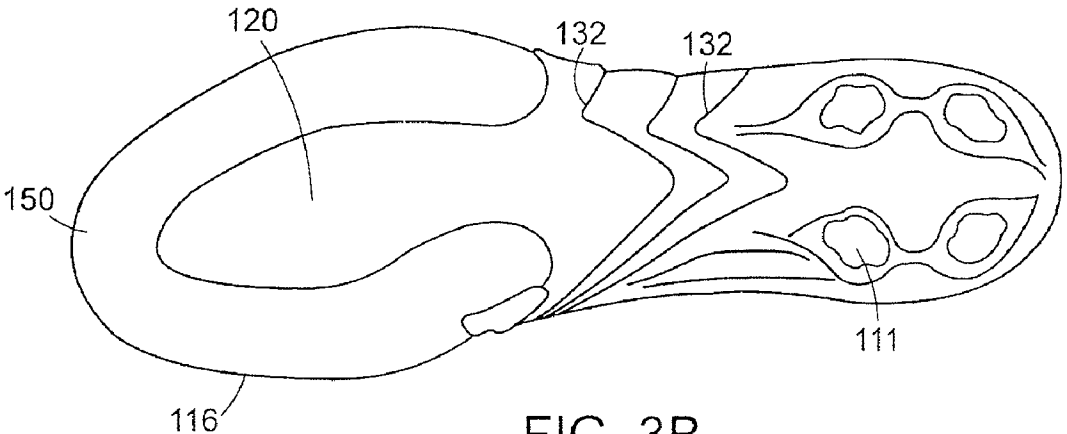
Figure 3C:
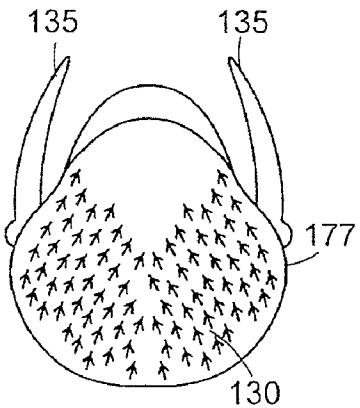

A transparent plastic material can be used for the sole element 10 or portions thereof (see, for example, portion 177 in FIGS. 3A and 3C). As a result, the outer appearance of the shoe can, at least in the heel region 30, easily be determined by elements arranged inside the shoe, for example the color of a sock or of an additional insole. Alternatively or additionally, a coating, coloring, and/or printing can be added to the sole element 10 for aesthetic purposes, for example, the addition of a team logo or other indicia.

An optional reinforcing element 50 for the sole can be included in the forefoot region 16. The reinforcing element 50 can be manufactured in one piece together with the overall sole element 10. Alternatively, the reinforcing element 50 for the sole can be separately manufactured and later attached to the sole element 10 by, for example, gluing, welding, or other techniques known to the person of ordinary skill in the art.

In the embodiment shown in FIGS. 1 and 2, a plurality of receptacles 11 for studs 12 (or other types of profile elements) can be arranged in the sole area 20. The exact number and arrangement of the receptacles 11 will vary to suit a particular application. In one embodiment, these receptacles 11 are provided simply as appropriate openings in the one-piece sole element 10. It is, however, also contemplated and within the scope of the invention to directly mold more complex receptacles having, for example, threads or a snap-connection for attaching a stud, which reduces the time-consuming assembly of a plurality of individual components. Examples of receptacles and studs are disclosed in the assignee's issued U.S. Pat. Nos. 6,301,806, 6,957,503, and 7,047,675; the entire disclosures of which are hereby incorporated by reference herein.

FIGS. 3A-3C depict a side view, a bottom view, and a rear view of an embodiment of a sole element 110 for use in a soccer shoe. The depicted sole element 110 is similar to the sole element 10 of FIG. 2 insofar as the sole element 110 includes a sole area 120, a heel cup 130 having an upper edge 131, a reinforcing element 150 arranged in a forefoot region 116, and receptacles 111. The heel cup 130 can be transparent or include a transparent portion 177, as described hereinabove. Furthermore, the receptacles 111 are shown arranged in an area of the sole element 110 corresponding to a wearer's heel; however, the receptacles 111, along with their mating studs, can be arranged anywhere in the sole element 110 to suit a particular application.

As can be seen in FIGS. 3A and 3C, the lateral and the medial side regions 135 extend substantially equally in an upward direction up to an instep region of the shoe. Furthermore, the sole element 110 of FIGS. 3A-3C can include a plurality of reinforcing ribs 132. These ribs 132 can lead to an increased stiffness and a reduced wall thickness, thereby lowering the overall weight of the sole element 110. In addition, the larger side regions 135 further reduce the material necessary for an upper, because the side regions 135 can also exclusively form portions of the sidewalls of the shoe.

Figure 4A:
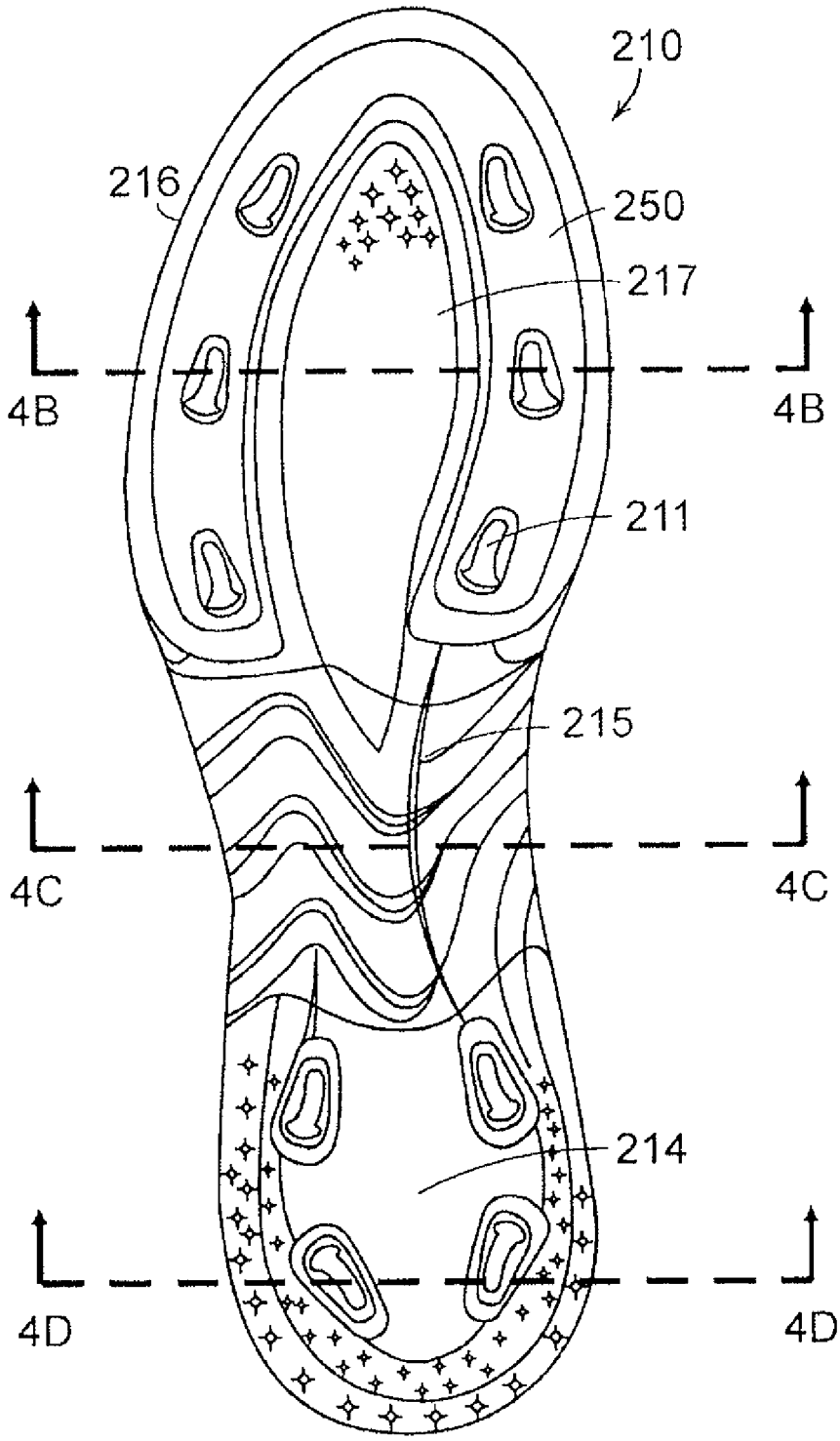
FIG. 4A is a schematic bottom view of a sole element in accordance with an alternative embodiment of the invention.

FIG. 4A depicts an embodiment of a sole element 210 having adjacent regions made from different materials. Apart from a sharp transition from one material to another, it is also contemplated and within the scope of the invention to provide a gradual transition from one material to the other. In one embodiment, a heel region 214 and a central portion 217 of a forefoot region 216 may include a harder TPU. In between these regions, i.e., a midfoot region 215 (generally, the region corresponding to an arch of the wearer's foot), a particularly stretchable TPU can be used to compensate for the loads occurring in this region of the foot. FIG. 4A further depicts a U-shaped reinforcing element 250 arranged along peripheral edge regions of the front of the sole, as previously described with respect to reinforcing element 50, that can also provide reinforcement for the receptacles 211 for the studs.

Figure 4D:
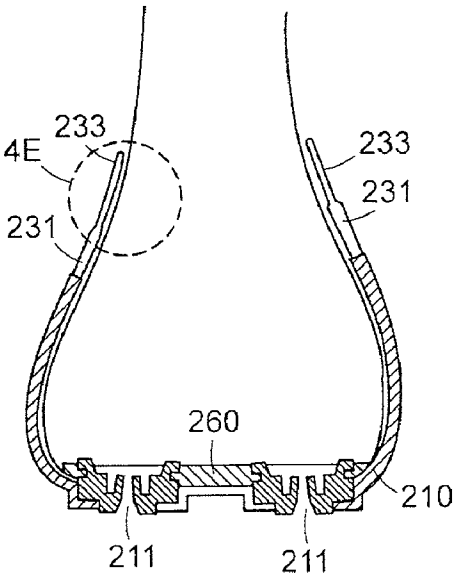
FIGS. 4B-4D are schematic cross-sectional views of the sole element of FIG. 4A taken along the lines B-B, C-C, and D-D, respectively in FIG. 4A, depicting different materials in different regions of the sole element.
Figure 4C:
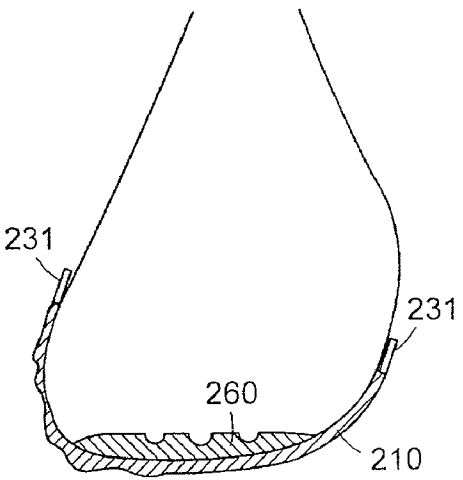
Figure 4E:
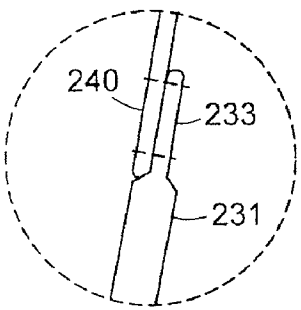
FIG. 4E is an enlarged view of a portion of the sole element depicted in FIG. 4D.
Figure 4B:
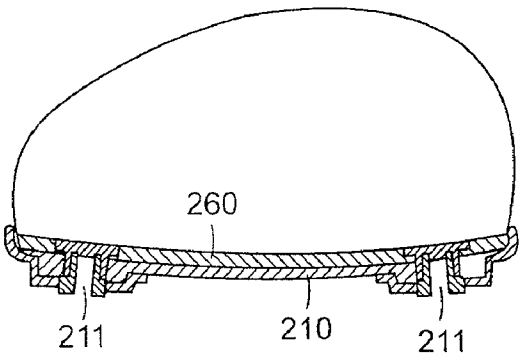

As described hereinabove with respect to FIG. 2, the upper edge regions 231 can use, for example, softer materials than the remaining regions of the sole element 210. In addition, as shown in the cross-sections of FIGS. 4B-4D, the sole element 210 can have a varying wall thickness. The dimensions given in FIGS. 4B-4D are exemplary only, and the dimensions of a sole element 10, 110, 210 in accordance with the invention can vary to suit a particular application. Varying the wall thickness of the sole element 210 also contributes to the optimization of the overall weight of the sole element 210, without endangering its stability and, thereby, the stability of the shoe.

In a particular embodiment, the edge regions 231 are comparatively thin at their upper ends 233. If the material of an upper of the shoe, such as an (artificial) leather or a textile material, is attached to the outside of the edge regions 231, there will be a smooth transition on the outside from the partial area of the sidewall of the shoe, which is exclusively formed by the one-piece sole element 210, to the other areas where a common shoe upper 240 forms the sidewall. See FIG. 4E, where a portion on the upper 240 is shown attached to the upper ends 233 of the edge regions 231.

In general, the sole element 210 can be so stiff that it forms a frame or chassis for the overall shoe. In this case, only a soft insole is disposed in the interior of the sole element to ensure the required wearing comfort. In another embodiment, however, the sole element 210 can be made from a comparatively thin and soft material in the region of the sole area. In this embodiment, the stability can be provided by an inner chassis 260 as explained in detail in U.S. Patent Publication No 2005/0198868, the entire disclosure of which is hereby incorporated by reference herein, and as schematically shown in FIGS. 4B to 4D. Other possible chassis for use in a shoe in accordance with the invention are disclosed in assignee's issued U.S. Pat. Nos. 5,915,820 and 6,954,998, the entire disclosures of which are hereby incorporated by reference herein. Also contemplated and within the scope of the invention are mixed embodiments, where the required stability results from a combination of a semi-rigid sole element 210 and a semi-rigid inner chassis 260.

Figure 5:
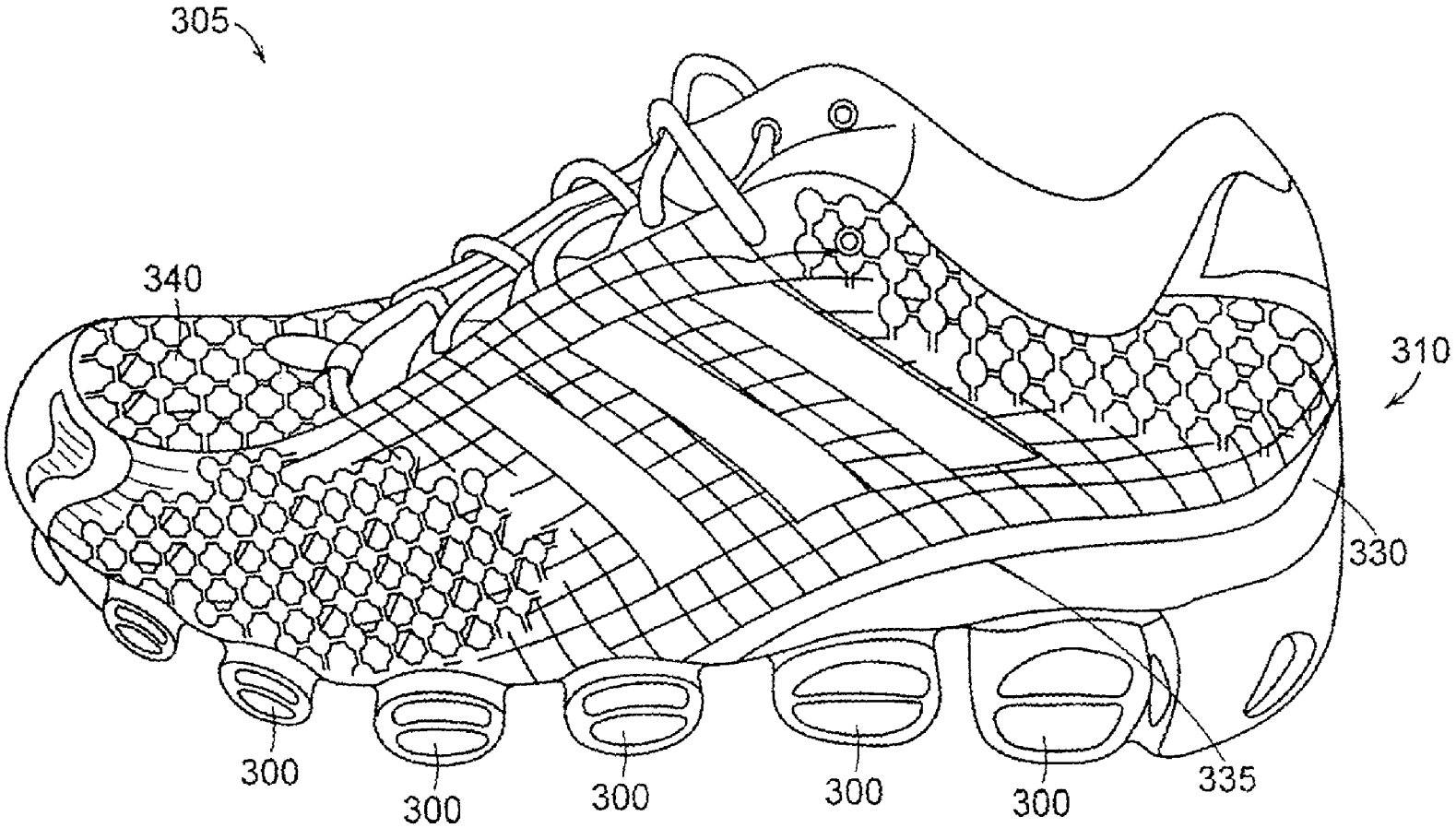
FIG. 5 is a schematic perspective side view of a shoe in accordance with an alternative embodiment of the invention.
Figure 6:
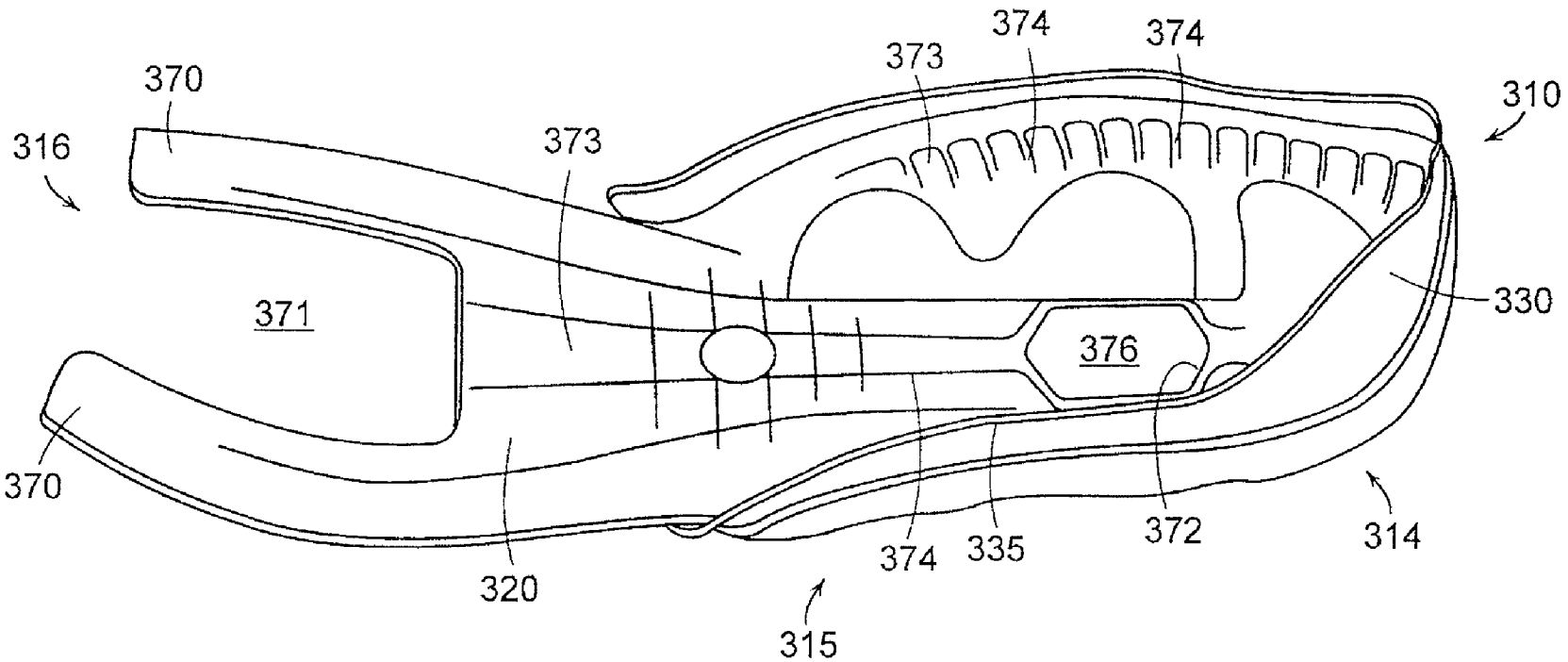
FIG. 6 is a schematic perspective side view of a sole element for use in the shoe of FIG. 5, in accordance with one embodiment of the invention.
Figure 7:
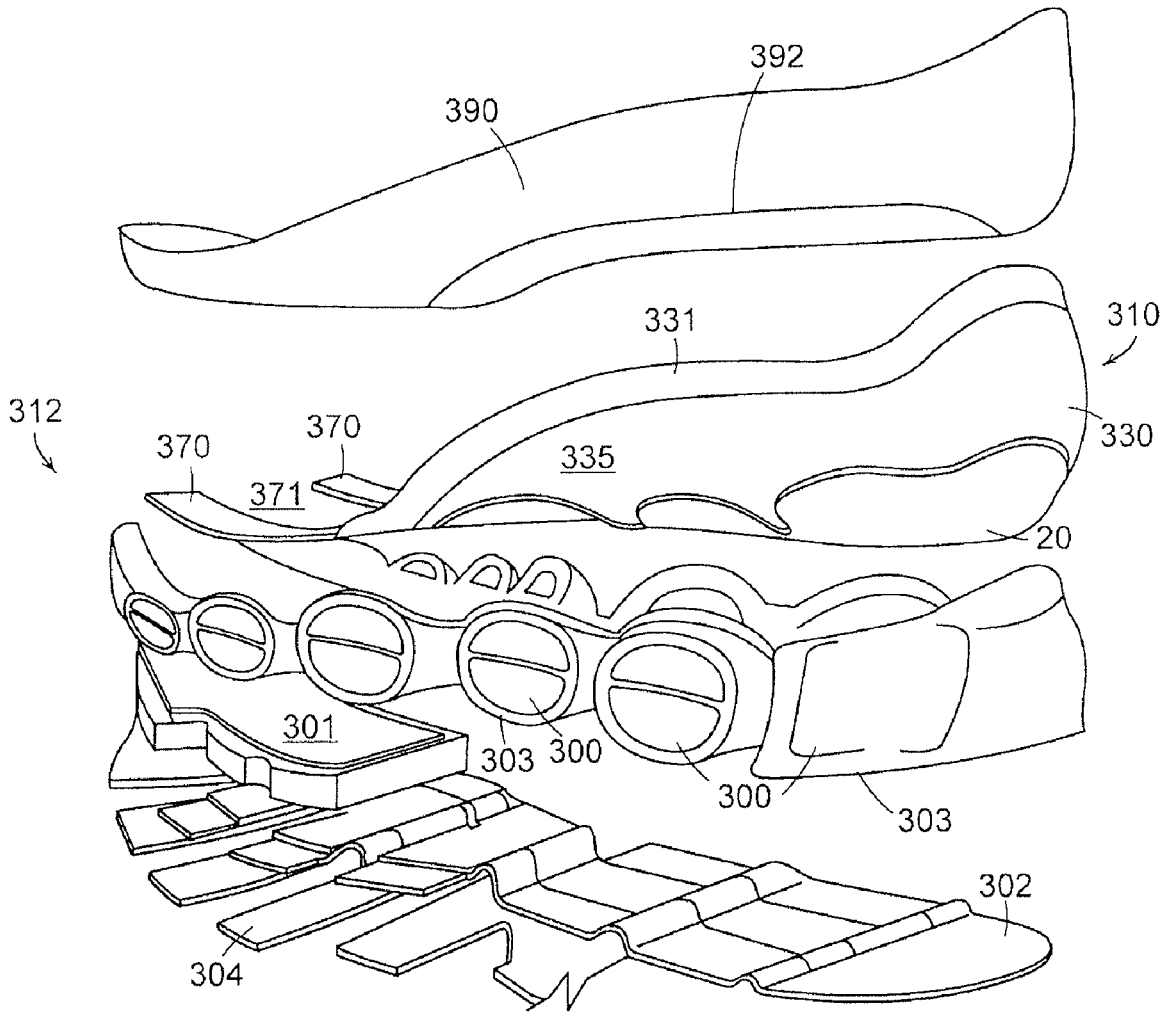
FIG. 7 is a schematic exploded view of the sole assembly portion of the shoe of FIG. 5.

FIGS. 5 to 7 depict an alternative embodiment of the invention as embodied in a running shoe 305. As shown in FIGS. 5 and 7, the sole element 310 (shown in detail in FIG. 6) is arranged above a plurality of cushioning elements 300. The cushioning elements 300 may be the foamless cushioning elements disclosed in the above-mentioned patent documents or EVA elements. It is also contemplated and within the scope of the invention to arrange a sole element in accordance with the invention above a continuous EVA midsole.

If individual cushioning elements 300 are used, the sole element 310 additionally serves as a load distribution plate, which distributes the ground reaction forces acting from below and the weight acting from above to larger areas of the sole, so that localized pressure points are avoided. Directly attaching the sole element 310 to the individual cushioning elements 300 can be particularly effective.

The sole element 310, as shown in FIG. 6, also three-dimensionally encompasses the wearer's heel by means of a heel cup 330 and includes in a midfoot region 315 upwardly extending side regions 335; however, extension of the sole element 310 into the forefoot region 316 is limited in this embodiment. The sole element 310 includes lateral and medial edge reinforcements 370, which serve to avoid misorientations, such as pronation and supination. In addition, there is a large open recess 371 in this embodiment in the forefoot region 316. The two edge reinforcements 370 can be deflected independently of each other due to the elasticity of the material used, thereby allowing a torsional movement of the forefoot region 316 of the shoe 305 relative to a rearfoot region 314 of the shoe 305.

The recess 371 allows the wearer's foot to contact in this region of the shoe an additional cushioning element 301 that is arranged at least substantially directly below the recess 371 (see FIG. 7). A suitably adjusted EVA element can be used for the cushioning element 301 to provide the highest wearing comfort for the substantial loads arising during the repeated push-off from the ground and, in particular, protect the sensitive heads of the metatarsals against excessive loads. At the same time, the recess 371 contributes to a reduction in the overall weight of the shoe 305.

An intermediate layer 302 can be arranged below the cushioning elements 300, 301. The intermediate layer 302 can interconnect with the bottom surfaces 303 of the individual cushioning elements 300, 301. This arrangement stabilizes the cushioning elements 300, 301 and protects, in particular, against shearing forces on the individual cushioning elements 300, 301. The sole assembly 312 can terminate on its lower side with an outsole layer 304 that can be arranged below the intermediate layer 302 and determine the friction properties of the shoe 305. It is to be understood that the described design is only exemplary and that, for example, the intermediate layer 302 and the outsole layer 304 may be provided as a single layer, further simplifying the manufacture of a shoe in accordance with the invention. Conversely, it is possible to provide additional layers, for example directly on top of the outsole layer 304.

In the heel or rearfoot region 314 of the sole area 320, the embodiment of the sole element 310 shown in FIG. 6 can include an additional recess 372. In one embodiment, the recess 372 can be arranged in the center of the heel region corresponding to the area directly below the wearer's calcaneus bone. The recess 372 serves to avoid the extremely high loads in the heel region, when the majority of runners contact the ground, and cause damage to the sole 310 or an uncomfortable feeling, for example, if a supplied overlying insole layer 390 (FIG. 7) is fully compressed below the calcaneus bone and can no longer provide any cushioning. The recess 372, therefore, allows a controlled expansion of the cushioning insole material in a downward direction; however, in order to avoid damage to the insole 390 by this process, the insole 390 may include on its lower side a suitable reinforcement 392 or a suitable reinforcement 392 can be integrated into the insole 390. The reinforcement 392 may be a separate component made from, for example, TPU or an EVA of a different thickness, which is embedded into the insole 390 or later connected to the insole 390 by, for example, gluing, welding, co-injection, or other suitable technique.

It is also contemplated and within the scope of the invention to arrange an additional, particularly soft cushioning element 376 within or below the recess 372 of the sole element 310 in a similar manner as in the forefoot region 316. Independent from the cushioning alternatives for the center of the heel region, the recess 372 allows a greater cushioning movement compared to the border regions of the sole element 310. The size and the shape of the recess 372 may vary depending, for example, on the weight of the runner and/or the preferred field of use. In one embodiment, the recess 372 has a length of about 3 cm to about 5 cm and a width of about 1 cm to about 3 cm. An effect similar to providing a recess is also obtained, if the sole area 320 is made from a softer and more flexible material in a region corresponding to the location of the recess 372.

FIGS. 5 to 7 also depict a plurality of small ventilation openings 373 in a portion of the sole element 310, in particular the portion that exclusively forms the sidewall of the shoe 305. Further ventilation openings 373 can be arranged in the midfoot region 315 of the sole area 320. As a result, the ventilation properties of the shoe 305 can be easily improved. In addition, as shown in FIG. 6, the sole element 310 can include a plurality of reinforcing ribs 374. The reinforcing ribs 374 can provide a high amount of stiffness at a low material thickness. The specific arrangement of the openings 373 and/or the ribs 374 may vary depending on the size and the field of use of the shoe 305.

Having described certain embodiments of the invention, it will be apparent to those of ordinary skill in the art that other embodiments incorporating the concepts disclosed herein may be used without departing from the spirit and scope of the invention, as there is a wide variety of further combinations of a sole element, a heel cup, side walls, uppers, and ground engaging surfaces that are possible to suit a particular application and may be included in any particular embodiment of a shoe sole in accordance with the invention. The described embodiments are to be considered in all respects as only illustrative and not restrictive.

What is claimed is:

1. A shoe comprising:

an upper; and a one-piece outsole element, the outsole element comprising:

a sole area configured to extend below a wearer's foot; and a heel cup extending upwardly from at least a portion of the sole area and configured to three-dimensionally encompass a heel of the wearer's foot, wherein the heel cup solely forms at least a portion of a sidewall of the shoe and wherein the outsole element lacks a sidewall extending forward of a midfoot region of the wearer's foot.

2. The shoe of claim 1, wherein the sidewall extends forward of the heel cup to a region corresponding to a midfoot region of a wearer's foot.

3. The shoe of claim 1, wherein the one-piece outsole element comprises at least two materials and is formed by a multi-component injection molding process.

4. The shoe of claim 1, wherein at least a portion of the shoe upper is attached to an upper edge of the heel cup.

5. The shoe of claim 4, wherein the upper edge comprises at least one of a reduced thickness and a softer material than at least one other region of the outsole element.

6. The shoe of claim 3, wherein the outsole element comprises a harder material in at least one of the heel cup and a central forefoot region of the outsole element than in at least one other region of the outsole element.

7. The shoe of claim 1, wherein the outsole element extends upwardly in a region corresponding to an arch of a wearer's foot to form a portion of the sidewall to encompass a midfoot region of the wearer's foot.

8. The shoe of claim 1, wherein the sole area of the outsole element extends from a heel region at least to a region corresponding to a midfoot region of a wearer's foot.

9. The shoe of claim 1, wherein the outsole element comprises at least one transparent region.

10. The shoe of claim 1, wherein the outsole element forms at least one ventilation opening.

11. The shoe of claim 1, wherein the outsole element comprises reinforcing ribs.

12. The shoe of claim 1, wherein the outsole element comprises at least one receptacle for receiving a profile element of the shoe arranged in the sole area of the outsole element.

13. The shoe of claim 12, wherein the receptacle forms an opening in the sole area.

14. The shoe of claim 1, wherein a region of the outsole element corresponding to a calcaneus bone of a wearer comprises at least one of an opening formed therein and a material softer than in surrounding regions of the outsole element.

15. The shoe of claim 14 further comprising an insole comprising a reinforcement in the region corresponding to the wearer's calcaneus bone.

16. The shoe of claim 14 further comprising an additional cushioning element arranged below the sole area in the region corresponding to the wearer's calcaneus bone.

17. A sole assembly for a shoe, the sole assembly comprising:

a sole element comprising:

a sole area at least partially extending below a region corresponding to a sole of a wearer's foot and configured to distribute loads arising thereon; and a heel cup extending upwardly from at least a portion of the sole area and configured to three-dimensionally encompass a heel of the wearer's foot, wherein the heel cup solely forms at least a portion of a sidewall of the shoe; and at least one cushioning element disposed at least partially below the sole area of the sole element, wherein the sole element lacks a sidewall extending forward of a midfoot region of the wearer's foot.

18. The sole assembly of claim 17 further comprising at least one of an insole, a midsole, and an outsole.

19. The sole assembly of claim 17 further comprising a plurality of cushioning elements arranged below the sole element.

20. The sole assembly of claim 19, wherein the cushioning elements are interconnected by at least one of an intermediate layer and an outsole on a bottom surface of the cushioning elements.

21. The sole assembly of claim 17, wherein a region of the sole element corresponding to a calcaneus bone of the wearer's foot comprises at least one of an opening formed therein and a material softer than in surrounding regions of the sole element.

* * * * *

UNITED STATES PATENT AND TRADEMARK OFFICE

CERTIFICATE OF CORRECTION

PATENT NO. : 7,954,259 B2
APPLICATION NO. : 11/732831
DATED : June 7, 2011
INVENTOR(S) : Bruno Jean Antonelli et al.

It is certified that error appears in the above-identified patent and that said Letters Patent is hereby corrected as shown below:

On the Title Page:

Below the paragraph beginning with "Item (65) Prior Publication Data ..." and ending with "... Nov. 8, 2007," insert the following paragraph:

--(30) Foreign Application Priority Data

April 4, 2006 (DE) ..... 10 2006 015 649.8--

Signed and Sealed this
Thirteenth Day of December, 2011

David J. Kappos

David J. Kappos
*Director of the United States Patent and Trademark Office*